US007407445B2

(12) United States Patent
Pedraza et al.

(10) Patent No.: US 7,407,445 B2
(45) Date of Patent: Aug. 5, 2008

(54) GOLF CLUB

(75) Inventors: Luis Pedraza, 43 Howitt Rd., Roxbury, MA (US) 02132; Bryan R. Hotaling, Arlington, MA (US)

(73) Assignee: Luis Pedraza, West Roxbury, MA (US)

( * ) Notice: Subject to any disclaimer, the term of this patent is extended or adjusted under 35 U.S.C. 154(b) by 0 days.

(21) Appl. No.: 11/149,874

(22) Filed: Jun. 10, 2005

(65) Prior Publication Data

US 2006/0281578 A1 Dec. 14, 2006

(51) Int. Cl.
*A63B 53/04* (2006.01)

(52) U.S. Cl. ..... 473/314; 473/340

(58) Field of Classification Search ..... 473/314, 473/340–342

See application file for complete search history.

(56) References Cited

U.S. PATENT DOCUMENTS

| | | | | |
|---|---|---|---|---|
| 2,926,913 | A | 3/1960 | Stecher | |
| 3,194,564 | A | 7/1965 | Swan | |
| 3,967,826 | A | 7/1976 | Judice | |
| 4,063,733 | A | 12/1977 | Benedict | |
| 4,290,606 | A | 9/1981 | Maxwell | |
| 4,383,690 | A | 5/1983 | Maxwell | |
| 4,650,191 | A | 3/1987 | Mills | |
| 4,846,477 | A | 7/1989 | Phelan | |
| 4,852,879 | A * | 8/1989 | Collins | 473/251 |
| 4,988,107 | A | 1/1991 | Sasse | |
| D317,807 | S | 6/1991 | Adams | |
| 5,183,255 | A * | 2/1993 | Antonious | 473/314 |
| 5,441,268 | A | 8/1995 | Shier | |
| 5,544,883 | A * | 8/1996 | Meyer | 473/313 |
| 5,620,379 | A | 4/1997 | Borys | |
| 6,017,281 | A | 1/2000 | Behling | |
| 6,350,208 | B1 | 2/2002 | Ford | |
| D458,658 | S | 6/2002 | Jung | |
| 7,101,288 | B2 * | 9/2006 | Thomas | 473/242 |
| 2003/0045369 | A1 * | 3/2003 | Murray et al. | 473/300 |
| 2004/0029647 | A1 | 2/2004 | Bennett | |
| 2004/0229711 | A1 | 11/2004 | Trumble et al. | |
| 2005/0215346 | A1 * | 9/2005 | Iwade | 473/313 |
| 2005/0227778 | A1 * | 10/2005 | Pollman | 473/252 |

* cited by examiner

*Primary Examiner*—Stephen Blau
(74) *Attorney, Agent, or Firm*—Gallagher & Dawsey Co, LPA; David J. Dawsey; Michael J. Gallagher

(57) ABSTRACT

A golf club with a shaft and an asymmetrical head, wherein said head has a gravitational center which is further from a trailing edge than said striking face and is disposed on a vertical plane which includes said grip axis.

14 Claims, 13 Drawing Sheets

GOLF CLUB

TECHNICAL FIELD

This invention relates generally to golf clubs, and more particularly to golf putters.

BACKGROUND

Many golf club designs have been introduced to improve golfers' accuracy, such as adding materials to dampen the impact with the ball, aligning the shaft with the club face placing the shaft forward of the club face, aligning the shaft with the center of gravity of the club head, adding enlarged alignment features, etc.

SUMMARY

It is desirable to strike a golf ball as squarely as possible on the "sweet spot" of the club face in order to properly hit the ball. The sweet spot is the preferred striking point on the club face. If the center gravity of the head of the club is not aligned with the grip axis, there is a tendency for the club head to rotate about the grip axis. When this occurs, the player must compensate for the rotation of the club. This rotation adds an additional variable to the complex nature of the golf swing. However, by placing the center of gravity proximate to the grip axis, the rotation of the club head about the grip axis is minimized, thereby minimizing one factor from the complex nature of the golf swing. Further, it is desirable to align the grip axis proximate to the striking face of the club head or slightly ahead of the clubface (using an offset hosel) in order to strike the ball with a more natural stroke. Further, it is desirable that the club head have substantial depth to allow for alignment features.

According to one aspect of the invention, a golf club (such as a putter) includes a shaft, a grip and a head. The grip is at an upper end of the shaft and defines a grip axis inclined with respect to the vertical, the inclined grip axis defining a vertical plane, such as with the club held in its intended position to address a golf ball. The grip defines a radius about the grip axis. The head is secured to a lower end of said shaft and has a striking face and a trailing edge. Notably, the head has a gravitational center which is further from the trailing edge than the striking face and is spaced from the vertical plane a distance less than the grip radius.

In some embodiments, the center of gravity is within 0.84 inch of a striking face and in a vertical plane which includes the grip axis and yet has substantial depth of the putter to allow for alignment features. The golf club having a head with counterbalance weight forward of the striking surface positioned in such a way that the mass distribution will result in the center of gravity of the club head being aligned with the vertical plane created by the axis of the putter shaft. In some embodiments, positioning the center of gravity on the vertical plane defined by the axis of the shaft causes the club head is balanced about the axis while addressing the ball. In other embodiments, positioning the center of gravity on the axis of the shaft causes the club head to be balanced as it is rotated about the axis of the shaft. In addition, by locating the center of gravity at the intersection of the vertical plane created by the line defining the ideal striking location and on the axis of the shaft, the golf club will be in perfect balance and not rotate in the player's hand while the player addresses or strikes a golf ball.

In some embodiments, the head is asymmetrical, such as about the vertical plane containing the inclined grip axis as the club is positioned in contact with a ball.

The preferred proximity of the gravitational center will vary with grip radius in many cases. In some embodiments, the gravitational center is spaced less than about 0.65 inch from the vertical plane. In some cases, less than 0.5 inch, or even less than 0.3 inch.

Preferably, the gravitational center is disposed substantially on the vertical plane, and even more preferably substantially on the grip axis itself.

In some constructions, the gravitational center is disposed less than the grip radius from the striking face, and may be forward of the striking face, such as less than 0.84 inch or a standard golf ball radius forward of the striking face.

In some embodiments, the gravitational center coincides with a preferred striking point of the striking face.

In many clubs the striking face is oriented to impart a force in a direction substantially normal to the vertical plane.

In some constructions the head is formed using of a single material, and may include an alignment aid on the trailing edge. In some other cases the head is formed from a plurality of materials of different densities, and may have removable heel and toe counterweights. In some instances the club is provided in combination with replacement heel and toe counterweights of different weights, such that the user may adjust the weight or weight distribution of the head.

According to another aspect of the invention, a golf club includes a shaft having a grip region at an upper end, and a head. The grip region defines a grip axis. The head is secured to a lower end of said shaft and has a forward face and a trailing edge. Notably, the head has a gravitational center which is disposed further from the trailing edge than the striking face and substantially on the grip axis.

Various embodiments of this aspect of the invention feature various characteristics described above. In some cases the gravitational center is disposed substantially at a point defined by the grip axis and a sweet spot on the forward face of the head.

According to yet another aspect of the invention, a golf club has a shaft, a grip and a head. The grip is disposed at an upper end of the shaft, and defines a grip axis inclined with respect to the vertical, such that the inclined grip axis defines a vertical plane as the putter is held so as to address a golf ball. The grip defines a radius about the grip axis. A plurality of parts are assembled to form the head, secured to a lower end of said shaft, the head having a striking face and a trailing edge. Notably, the head has a gravitational center which is further from the trailing edge than the striking face, and is spaced from the vertical plane a distance less than the grip radius.

Various embodiments of this aspect of the invention feature various characteristics described above. In some cases the gravitational center is disposed substantially on the grip axis.

Other aspects of the invention feature methods of making the golf club disclosed herein, and methods of using such a club to strike a golf ball.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 2A is a top view of the golf club shaft of FIG. 1;

Like reference symbols in the various drawings indicate like elements.

DETAILED DESCRIPTION

Figure 1:
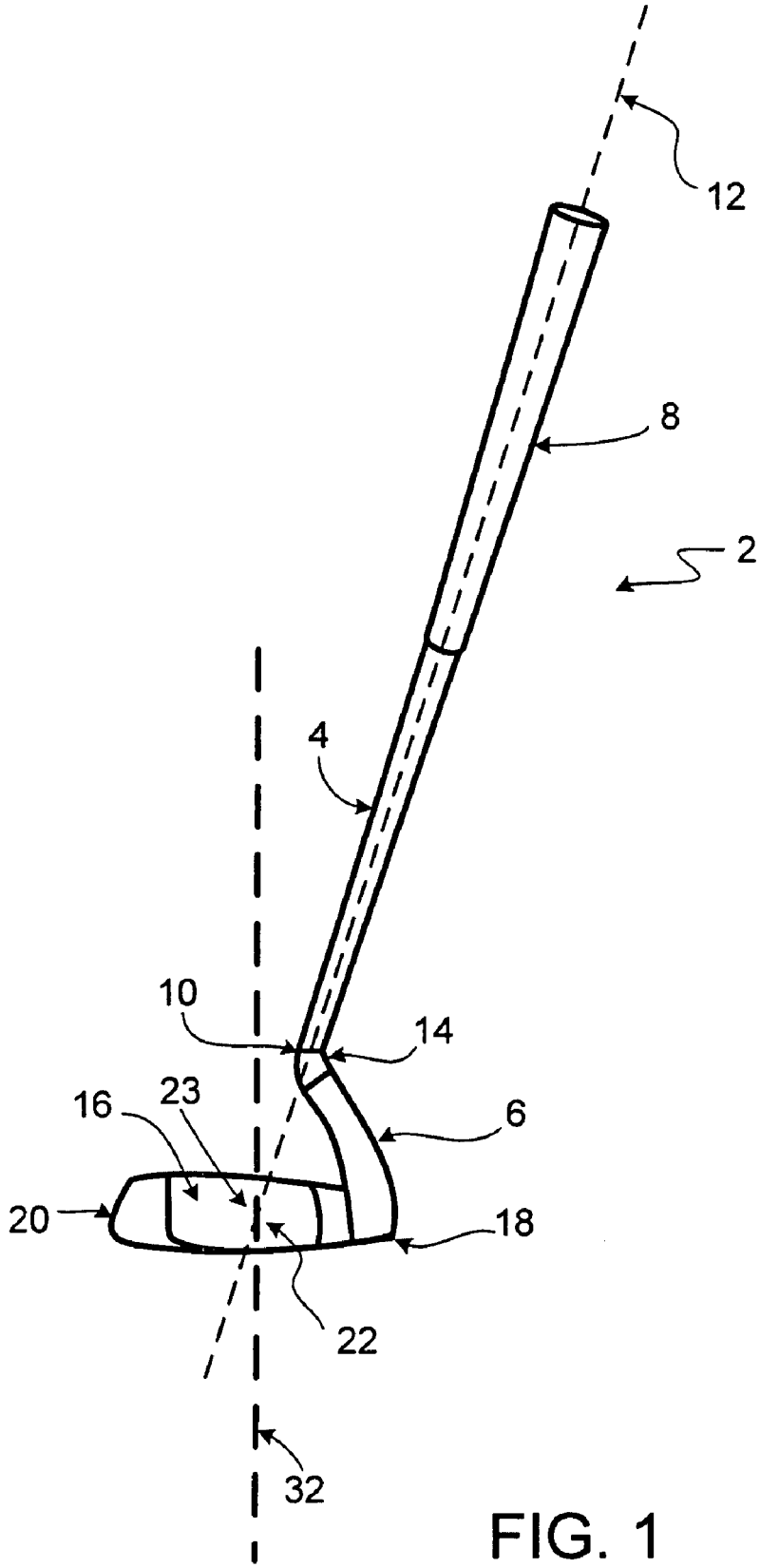
FIG. 1 is one embodiment of a golf club.

FIG. 1 is one embodiment of a golf club 2. The golf club 2 consists of two major components the shaft 4 and a head 6. The golf club 2 is assembled in a manner customary to the industry.

The shaft 4 consists of a grip region 8 and a lower end 10. The grip region 8 is conformed to be held by a person. The grip region 8 defines an axis 12 which intersects the center of gravity 22 of the head 6. The grip region 8 may be fitted with the material selected for comfort and control. The lower end 10 is secured to the hosel 14 of the head 6. In the present embodiment, the shaft 4 intersects the center of gravity of the head 6. Typically, the axis 12 is inclined with respect to a vertical axis 32. In other words, it is typically not perpendicular to a horizontal surface. The incline of axis 12 defines a vertical plane. In some embodiments the head 6 may be asymmetrical with respect to the vertical plane.

The head 6 consists of a hosel 14, a striking face 16, and a trailing edge (not shown in this view.) In the embodiment shown, the hosel 14 is attached to the heel 18 of the head 6. The striking face 16 is located between the heel 18 and the toe 20. The mass of the head 6 is distributed such that the center of gravity 22 of the head 6 is located proximate to the center of the striking face 16 and on axis 12. In some embodiments, the mass of the head 6 is distributed such that the center of gravity 22 is located slightly in front or on the striking face 16. In other embodiments, the mass of the head 6 is distributed such that the center of gravity 22 may be located slightly behind the striking face 16. The striking face 16 may have either a positive or negative inclination. By distributing the mass of head 6 such that the center of gravity 22 lies on axis 12, the club is less likely to twist while a user addresses the ball. In this embodiment, the sweet spot 23 on striking face 16 is located proximate to the center of gravity 22 and does not coincide with the center of gravity 22. However, in other embodiments, wherein the center of gravity 22 lies on striking face 16, the sweet spot 23 may be located at the same point as the center of gravity. In some embodiments, the center of gravity 22 is located proximate to the vertical plane. In some embodiments, the center of gravity 22 is located proximate to the axis 12. In other embodiments, the center of gravity 22 is located proximate to the axis 12 and the striking face of head 6.

Figure 2:
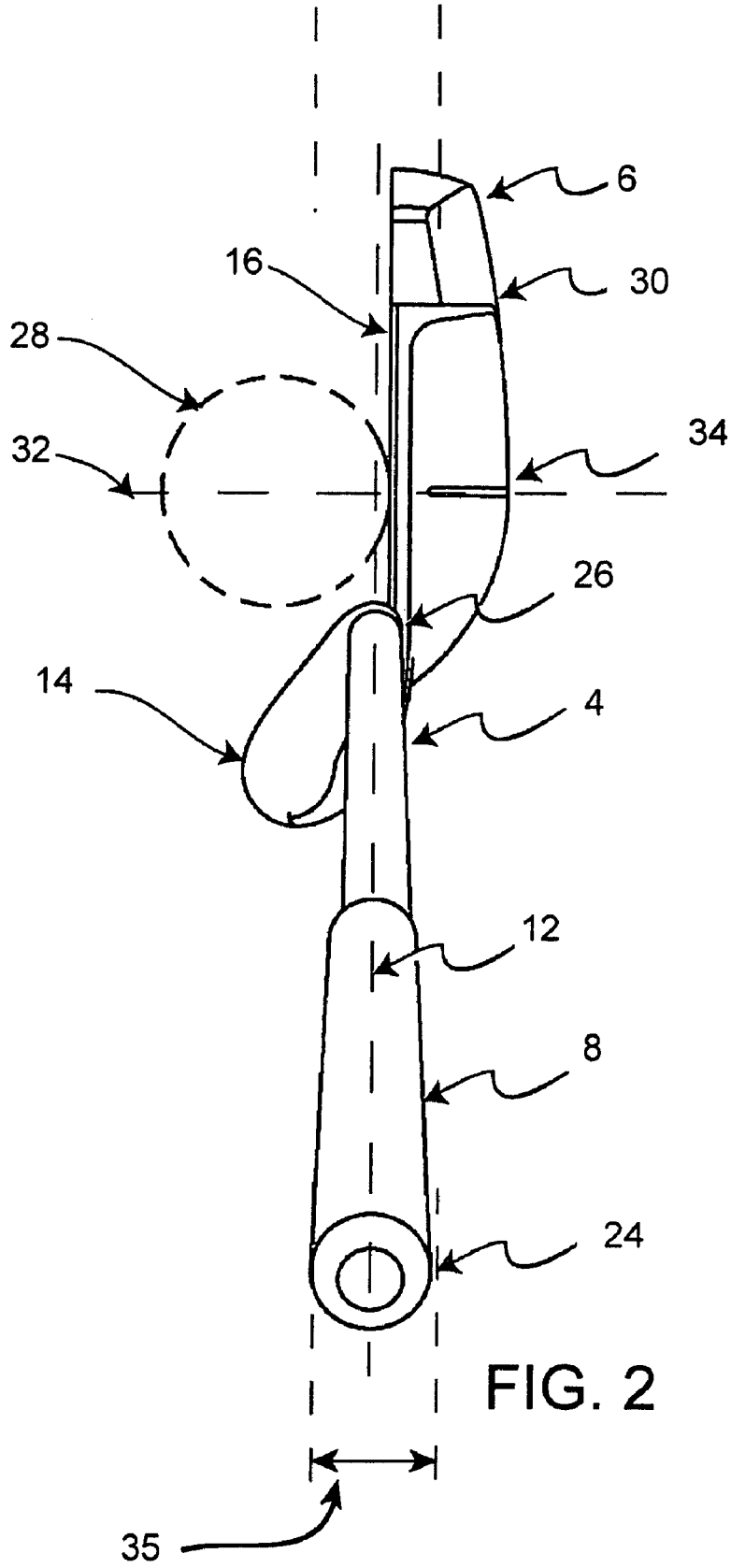
FIG. 2 is a top view the golf club of FIG. 1 in relationship to a golf ball.

FIG. 2 is a top view the embodiment of FIG. 1 in relationship to a golf ball 28. The shaft 4 consists of the grip region 8 at the upper end 24 and a lower end 26. The grip region 8 defines the axis 12, which as shown in this view is located upper to and front of striking face 16. The lower end 26 of shaft 4 is secured to the hosel 14 of the head 6.

The head 6 consists of the hosel 14, the front face 16, the trailing edge 30, the heel 18, and the toe 20. The striking face 16 is designed to impart a momentum in a vertical plane that includes vertical axis 32. Vertical axis 32 is defined as a horizontal line intersecting sweet spot 23 and axis 12. The momentum imparted to golf ball 28 may be either positively inclined to vertical axis 32, negatively inclined to vertical axis 32 or on vertical axis 32. The trailing edge 30 may further include an alignment aid 34. This embodiment features a substantial alignment aid 34 while maintaining the center of gravity proximate the striking face 16. The alignment aid 34 is designed to assist the user, while the user addresses a golf ball 28. Clubs without enlarged trailing edges tend to have short sight lines which would inhibit a golfer's ability to line up the club, the ball and the hole.

Turning to FIG. 2A, in the embodiment shown, the shaft diameter measures 0.6 inch across. The grip region 8 diameter 35 may vary. However, in some embodiments, the grip region 8 is 1.0 inch across the narrow side and 1.3 inches across the widest part.

Figure 3:
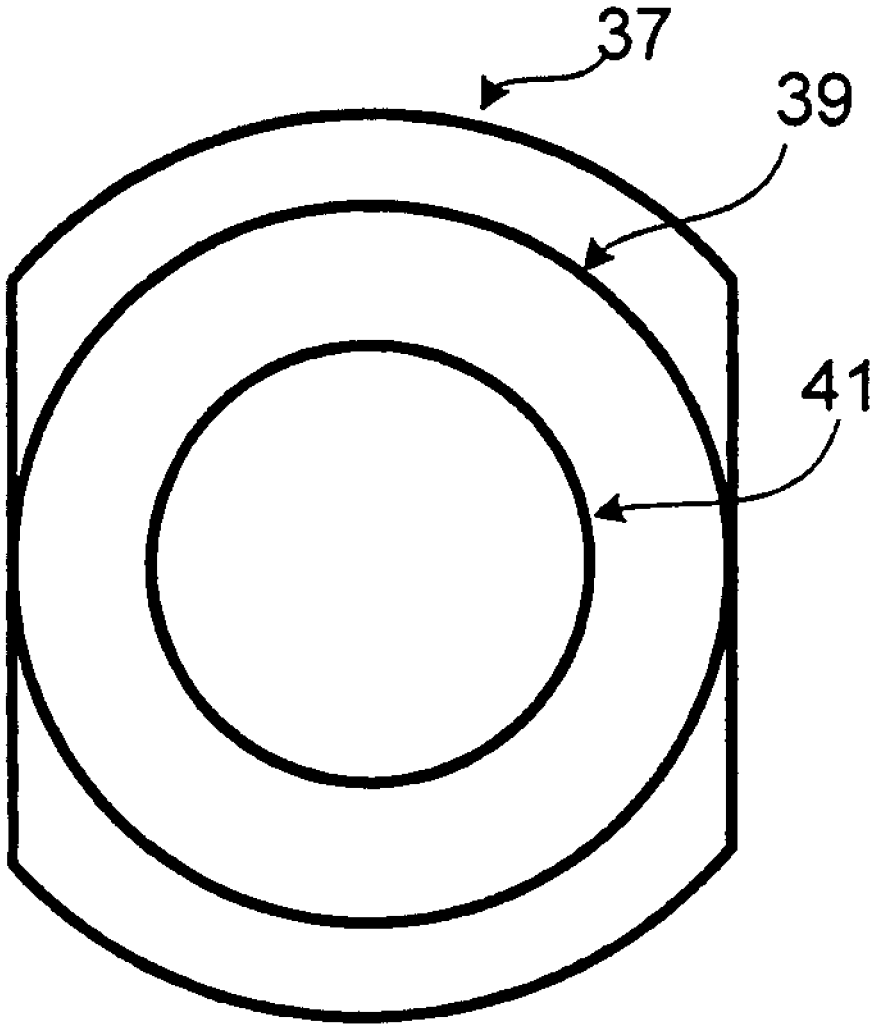
FIG. 3A is a top view of the golf club head of FIG. 1.
FIG. 3B is a front view of the golf club head of FIG. 1.
FIG. 3C is a side view from the toe of the golf club head of FIG. 1.
FIG. 3D is a side view from the heel of the golf club head of FIG. 1.
FIG. 3E is an isometric view from the rear of the golf club head of FIG. 1.
FIG. 3F is an isometric view from the front of the golf club head of FIG. 1.
Figure 3A:
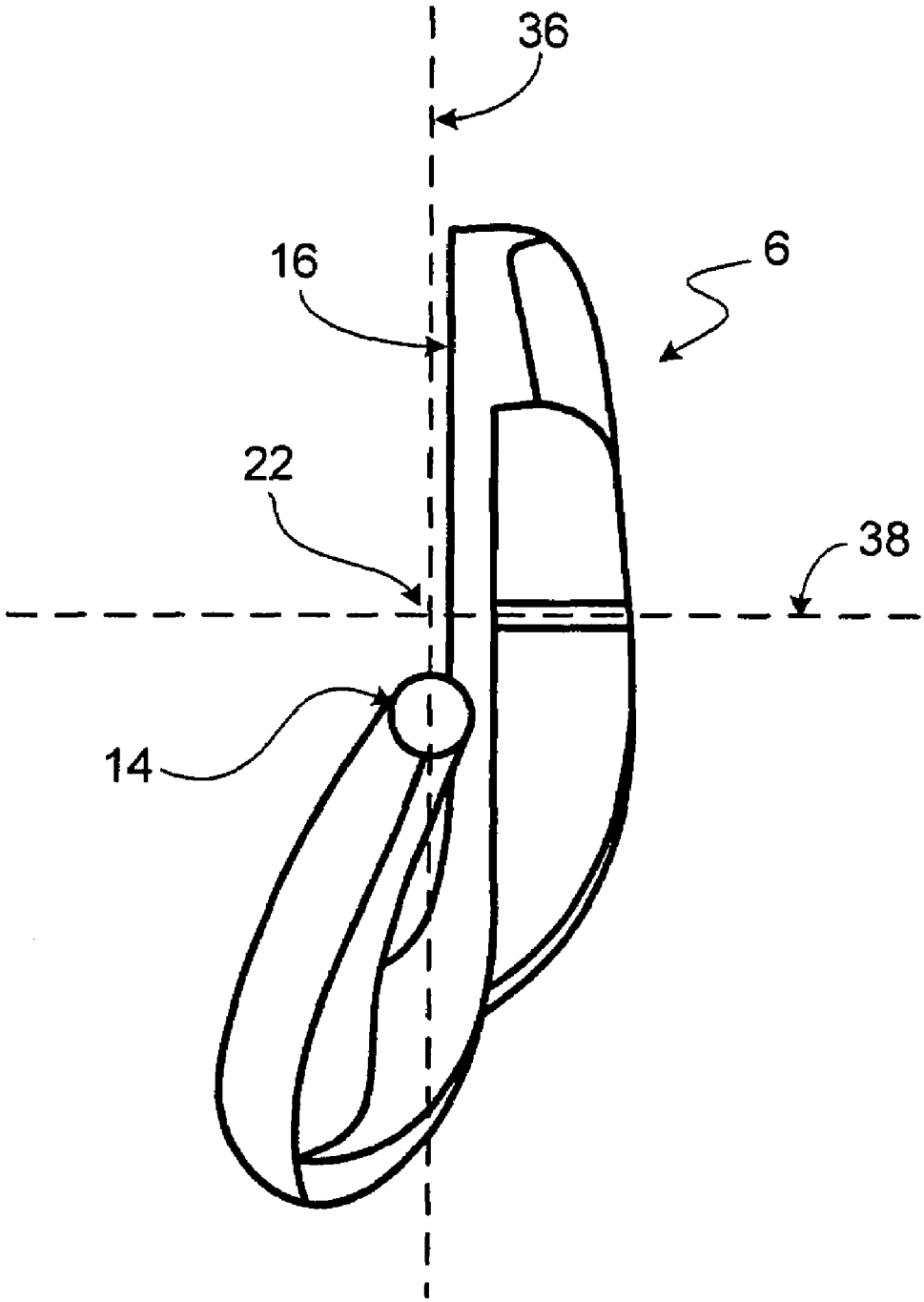

FIG. 3A is a top view of the head 6 without the shaft. The head 6 is shown in relationship to plane A 36 and plane B 38. The center of gravity 22 of the head 6 lies proximate to the sweet spot 23 on striking face 16 and the intersection of plane A 36 and plane B 38. Vertical axis 32 (not shown in this view) is a horizontal line that lies in plane B 38 and intersects the sweet spot 23. In this embodiment, the head 6 is constructed from a single material and the proper mass distribution is accomplished by selecting the shape of the head 6.

Figure 3B:
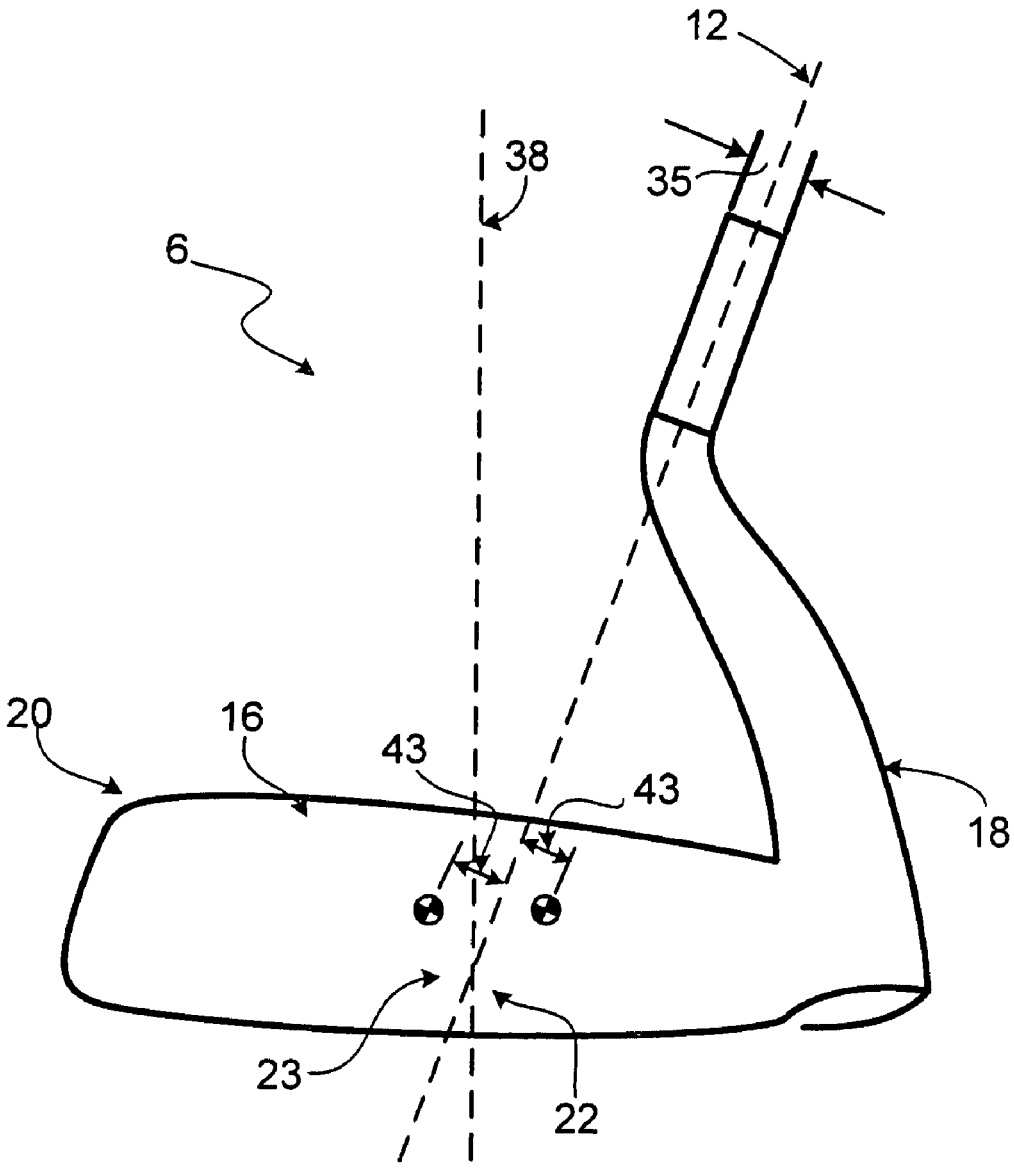

FIG. 3B is a front view of the head 6 without the shaft. The opening of the hosel 14 is aligned with axis 12. The center of gravity 22 of the head 6 is proximate to the intersection of the axis 12, which extends from the grip region (not shown in this view), plane A 36, and plane B 38. In this embodiment, mass distribution of the head 6 is such that the center of gravity 22 is in front of striking face 16 and is located roughly at the center of the striking face 16. As can be seen in this view, the location of the center of mass 22 of the head 6 is accomplished by balancing the mass of the toe 20 with the mass of the heel 18 such that the center of mass of the head 6 is proximate to the center of the striking face 16. The center of mass may be located within half of the diameter 35 as shown by dimension 43.

Figure 3C:
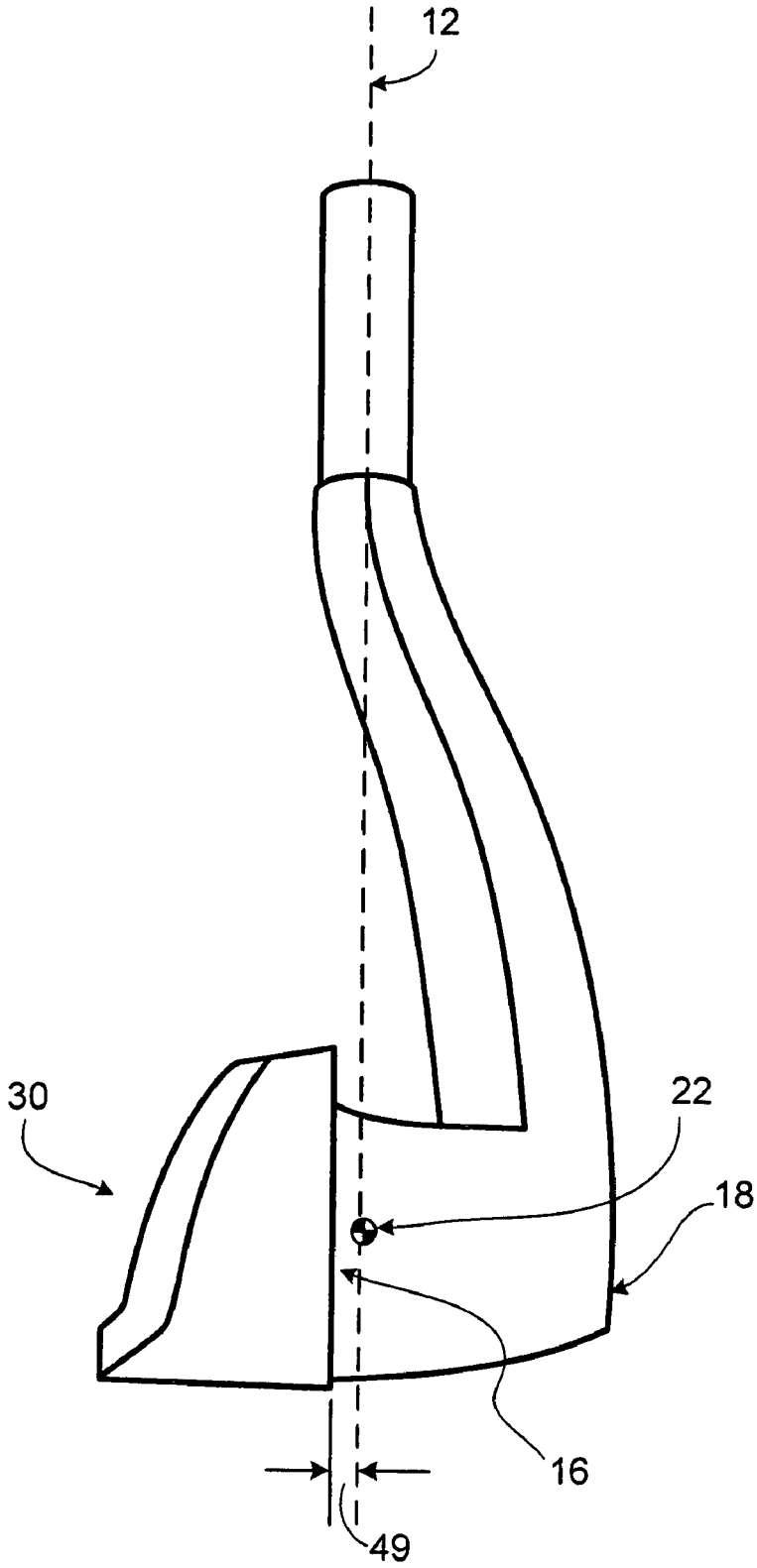

FIG. 3C is a side view from the toe side of the head 6 without the shaft. The center of mass 22 of the head 6 The center of mass of the trailing edge 30 is located behind axis 12 (not shown in this view) which lies on plane A 36. In contrast, the center of mass of the heel 18 is located forward of the striking face 16. In the present embodiment, this causes the gravitational center 22 to be located slightly in front of striking face 16 and on axis 12. In some embodiments, it may be advantageous to locate the gravitational center 22 above the sweet spot 23. In other embodiments, it may be advantageous to locate the gravitational center 22 below the sweet spot 23. In other embodiments the gravitational center may be located a distance 49 from the striking face. The distance 49 may be up to 0.84 inch.

Figure 3D:
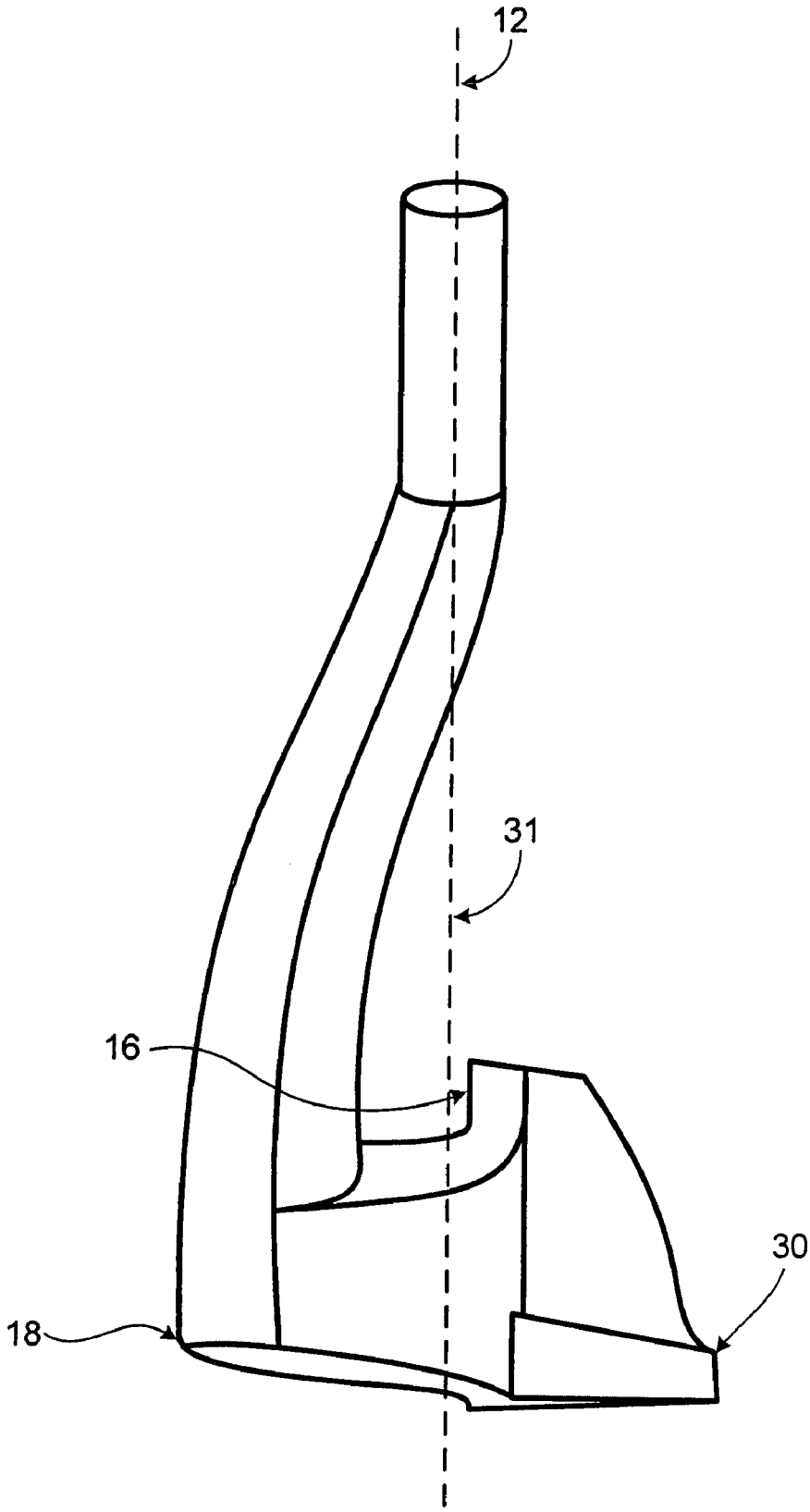

FIG. 3D is a side view from the heel side of the head 6 without the shaft. In this embodiment, the axis 12 lies a small distance in front of the striking face 16. The center of gravity (not shown in this view) lies on the axis 12 and is a small distance in front of the striking face 16 as shown by gap 31. The mass of the head 6 is shifted in front of the striking face 16 by shifting a majority of the mass of head 6 toward the heel 18 and less of the mass of head 6 toward the trailing edge 30. The gap 31 is preferably less than 0.84 inches forward of the striking face 16.

Figure 3E:
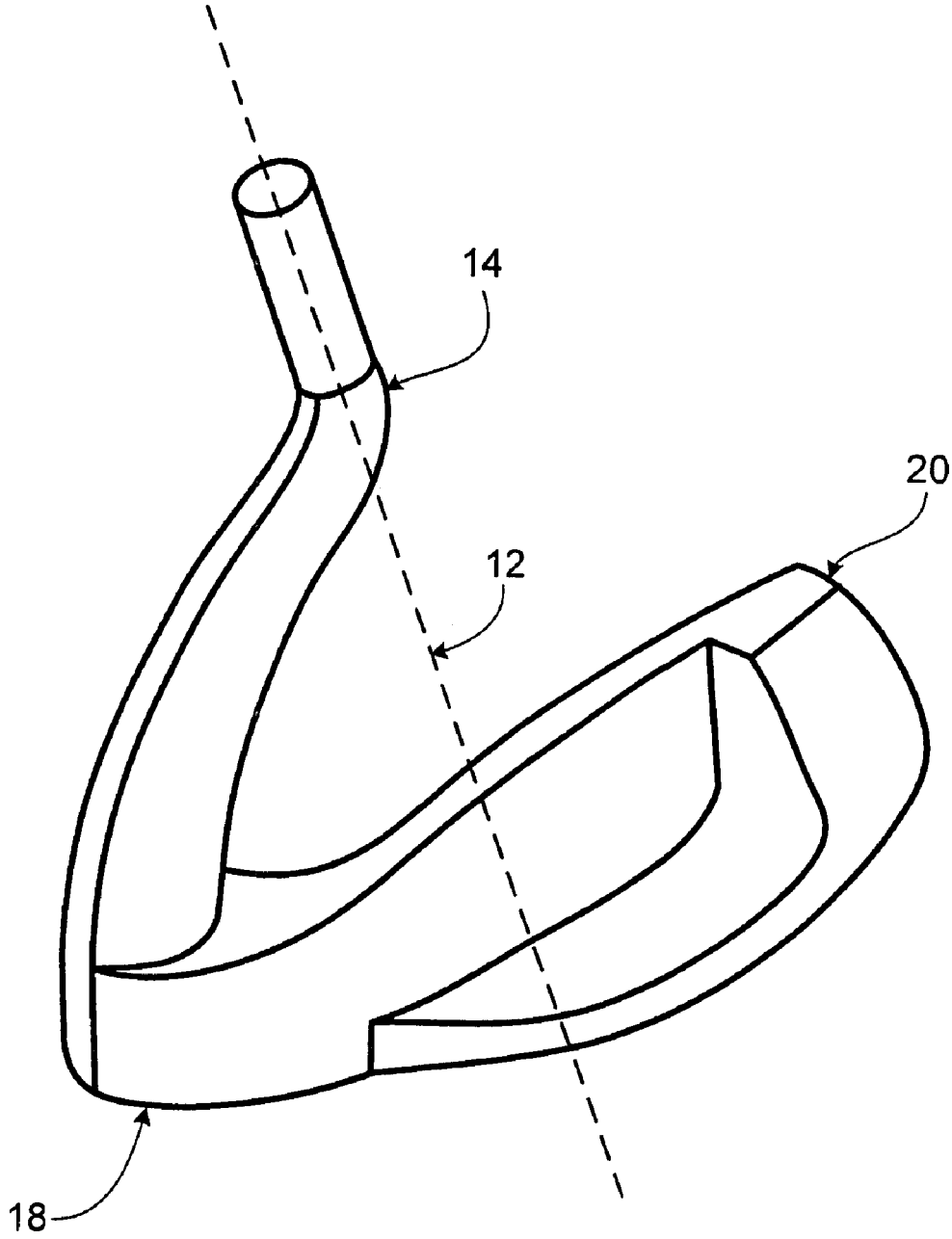

FIG. 3E is an isometric view of the asymmetrical golf club head of FIG. 1. In addition to the forward weight distribution at heel 18, a counterbalance is located at toe 20. The mass of heel 18 and hosel 14 causes the gravitational center 22 to shift forward. It also causes the gravitational center 22 to shift below axis 12. In order to bring the gravitational center 22 back into line with axis 12, a counterbalance is located proximate to toe 20.

Figure 3F:
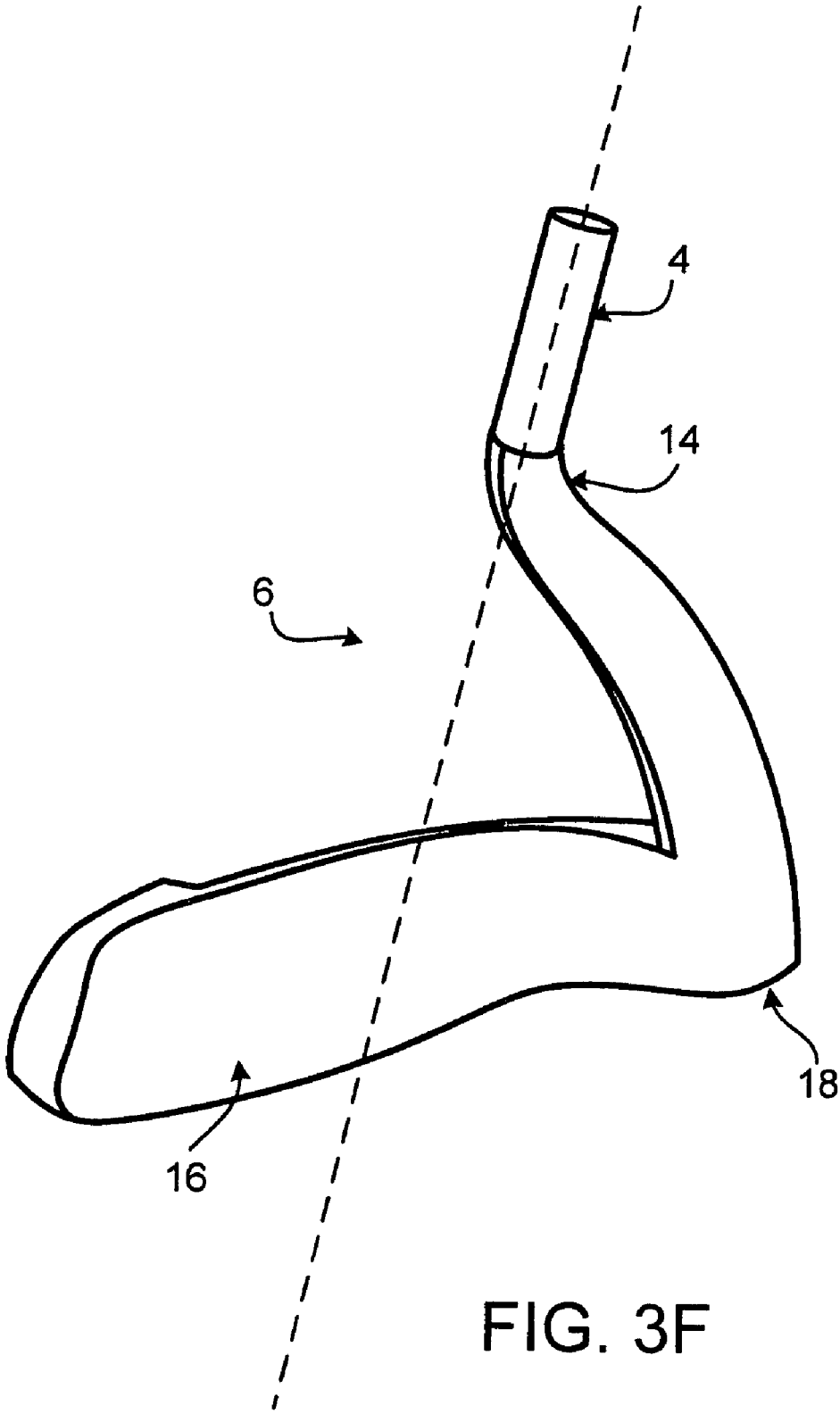

FIG. 3F is an isometric view from the toe side of the head 6 without the shaft. The shaft 4 is secured to hosel 14. At this juncture the heel 18 sweeps forward to shift a portion of the mass of head 6 forward. Then from the heel 18 the head 6 curves back to place the striking face 16 behind the axis 12. This placement allows a player to address a ball in such a manner that the axis 12 lines up with the center of gravity of head 6 and thereby, minimizing the torque caused by head 6.

Figure 4:
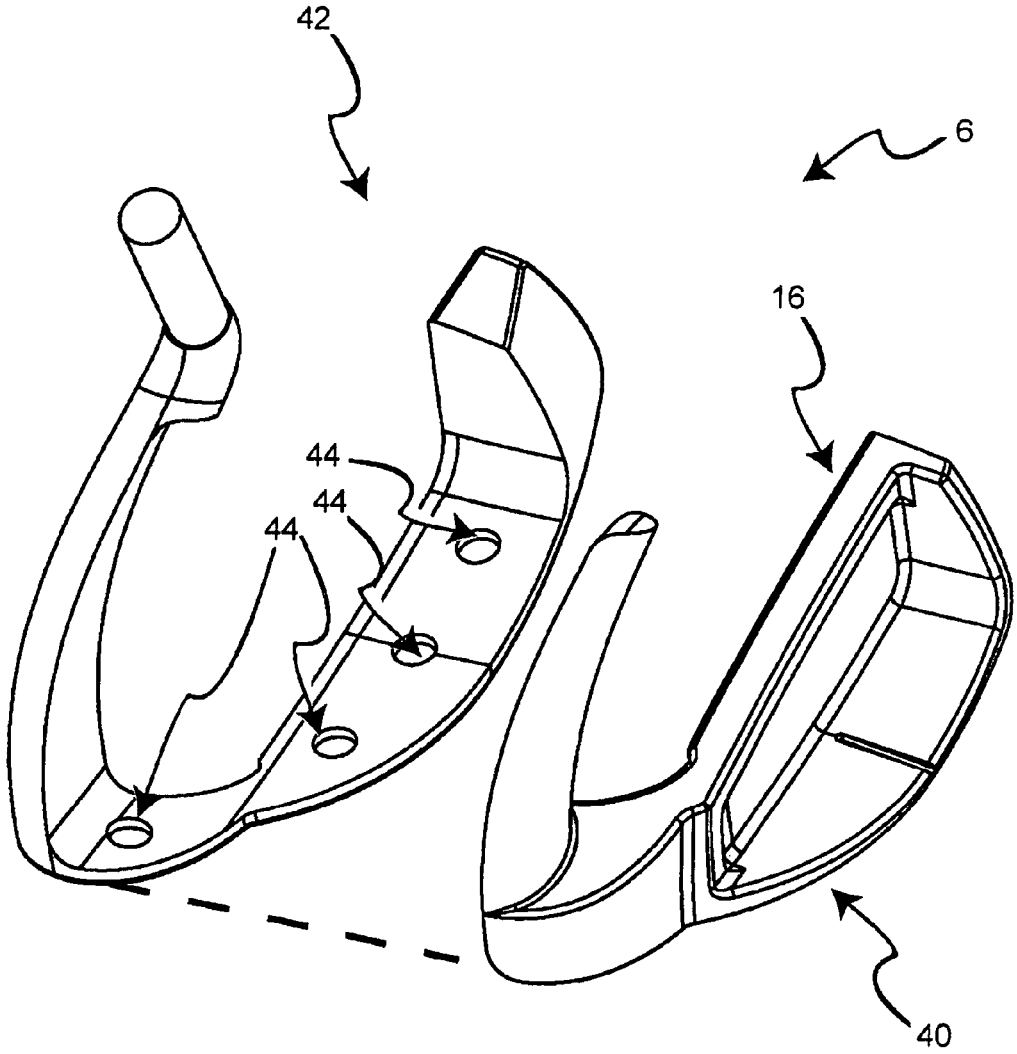
FIG. 4 is another embodiment of a golf club head.

FIG. 4 is an exploded view of one embodiment of the head 6 of FIG. 3A. The embodiment shown in FIG. 4 is constructed using two materials of different densities in order to accomplish the proper weight distribution. The placement of the center of gravity 22 in front of the striking face 16 may be accomplished by selecting a lower density material for face 40 then the material selected for base 42. One possible combination is to manufacture face 40 from 6061-T6 Aluminum and to manufacture base 42 from 304 Steel. The location of the center of gravity 22 may be changed by selecting different materials as needed.

Base 42 includes a plurality of openings 44 through which fasteners may be inserted to secure face 40 to base 42. Alternatively, other options include methods such as tongue and groove, insert molding, adhesives, or screwing them together.

In this embodiment, the head 6 is constructed from two parts of different materials. In other embodiments, the head 6 may be constructed from even more parts and materials. For example, face 40, the heel and the toe can be manufactured as three separate steel parts. The proper mass distribution may be accomplished by either varying the densities of the materials selected or varying the densities of the materials selected in combination with the shape of the head and by having interchangeable heel and toe weights.

In other embodiments, removable heel and toe counterweights may be included. The heel and toe counter weights may be removed and replaced by counterweights of different weights in order to make the club lighter or heavier.

Figure 5A:
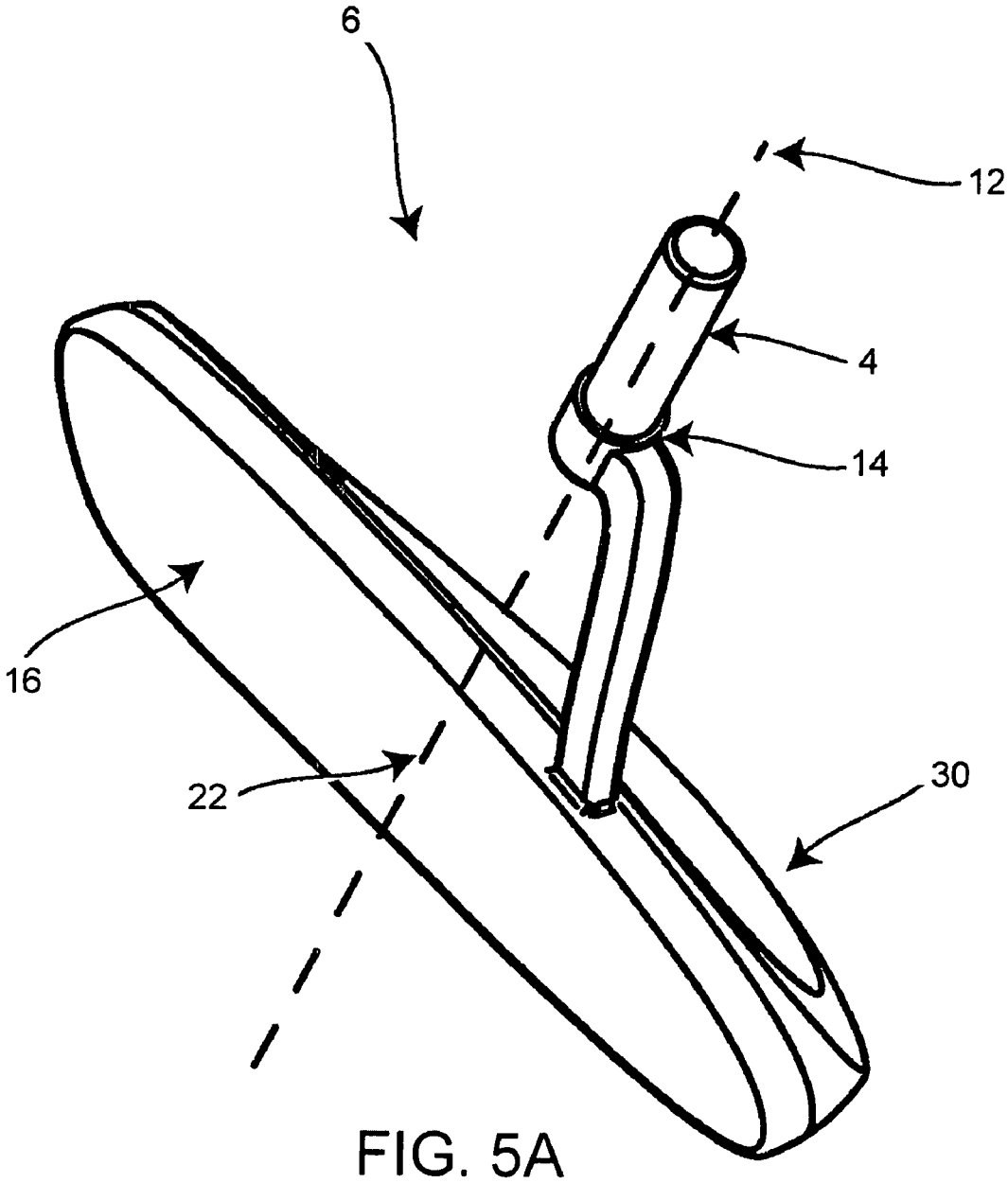
FIG. 5A is a front view of another embodiment of a golf club head.

FIG. 5A is a front view of another embodiment of head 6. This embodiment is a more traditional style putter where the axis 12 lies behind striking face 16. The putter head 6 with the center of gravity 22 on the axis 12 and slightly behind the sweet spot 23.

Figure 5B:
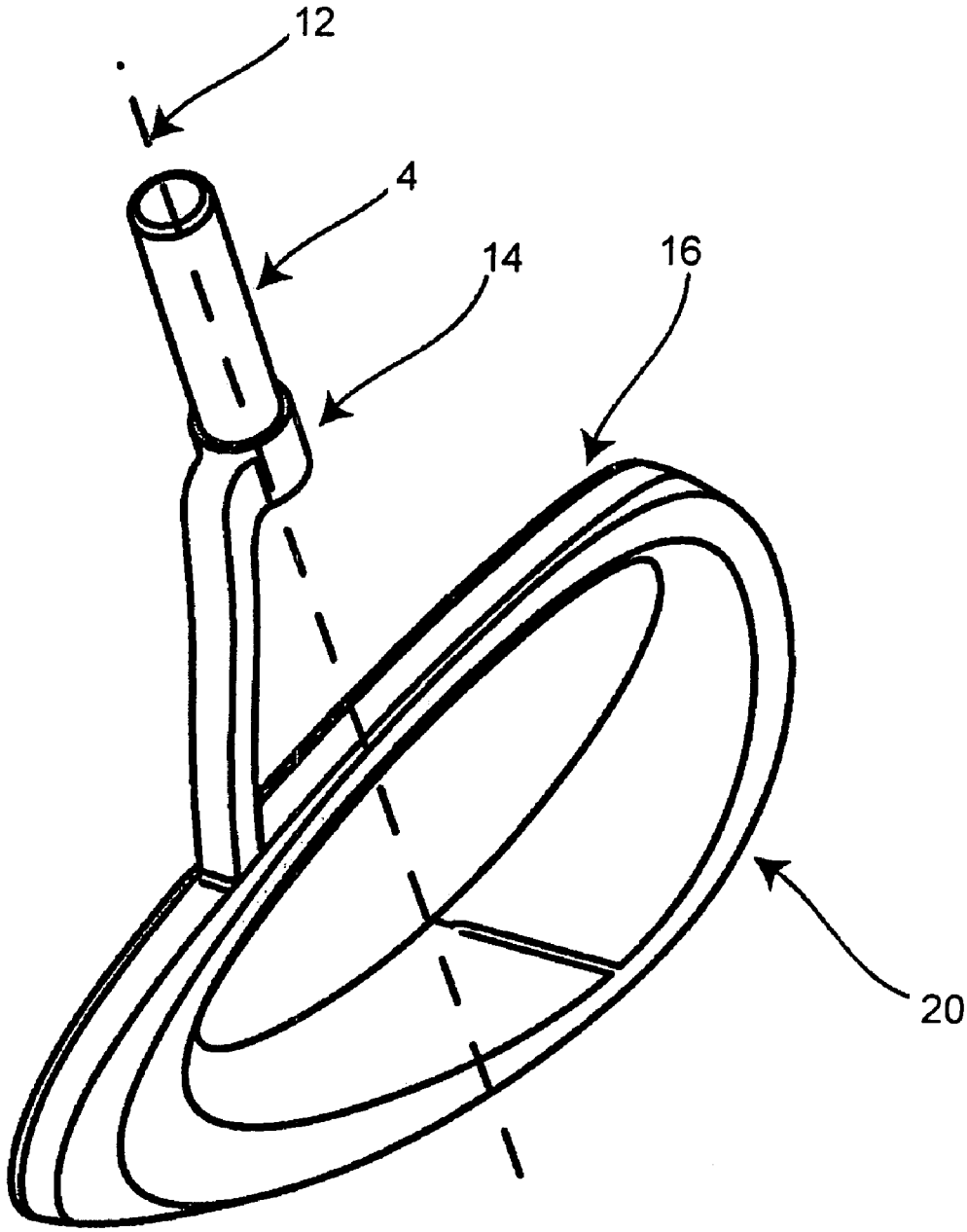
FIG. 5B is a rear view of another embodiment of a golf club head.

FIG. 5B is a back view of FIG. 5A. The trailing edge 30 may be constructed from a variety of different shapes. In the embodiment shown, the trailing edge 30 is constructed with a large cavity 31. The lack of material in the area of cavity 31 contributes to the forward shifting of the center of gravity 22. Another technique used to determine the location of the center of gravity 22 on the putter heads is the use of different density materials. Depending on the material selected for striking face 16 and trailing edge 30 the center of gravity 22 may be located either in front of or behind the striking face 16. In either case, the center of gravity 22 should be located on axis 12 or the vertical plane of axis 12. In the embodiment shown, hosel 14 is slightly behind the striking surface so the axis 12 lies slightly behind the striking face 16. The placement of the center of gravity 22 proximate to the striking face 16 is accomplished by selecting a material of significantly higher density for striking face 16 and a material of significantly lower density for trailing edge 30.

Figure 5C:
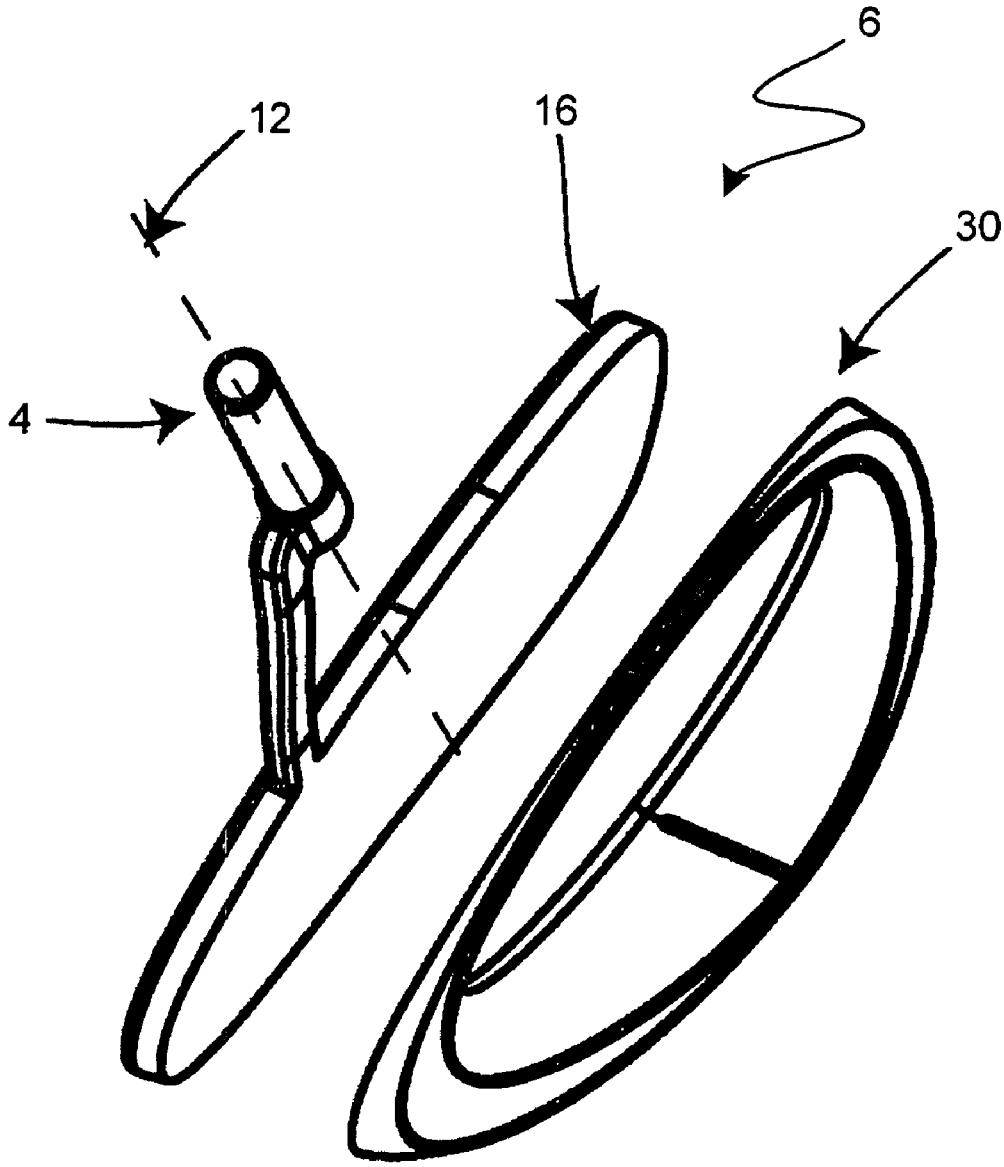
FIG. 5C is an exploded view of another embodiment of a golf club head.

FIG. 5C is an exploded view of FIG. 5A. The striking face 16 may be manufactured separately from trailing edge 30. As discussed above this gives the designer the flexibility of choosing the materials for each section. The striking face and the trailing edge may be bonded by using a variety of means known to persons of ordinary skill in the art.

A number of embodiments of the invention have been described. Nevertheless, it will be understood that various modifications may be made without departing from the spirit and scope of the invention. For example, the center of gravity can be located in front of the striking face and on the grip axis of a one-piece head by changing the shape so that a majority of the material mass is located in front of the forward face. It must be noted that for descriptive purposes, the mass distribution of head 6 above was described using a 2 dimensional frame of reference. It is understood that the mass of head 6 is distributed throughout the head 6 and not focused at points such as the toe 18 and heel 20. Given this fact, one of ordinary skill in the art will understand that many different and complex shapes can be created within the scope of the claims. Accordingly, other embodiments are within the scope of the following claims.

What is claimed is:

1. A golf club comprising:

a shaft;

a grip at an upper end of the shaft, the grip defining a grip axis inclined with respect to the vertical, said inclined grip axis defining a vertical plane, the grip defining a radius about the grip axis; and a head secured to a lower end of said shaft, said head having a striking face, a club head mass, a club head volume, a heel end nearest the shaft connection, a toe end furthest from the shaft connection, a sweet spot, and a tailing edge;

wherein a portion of the head between the heel end and the sweet spot projects forward of the striking face and no portion of the head between the sweet spot and the toe end extends forward of the striking face; and wherein said grip axis is within a distance defined by the grip radius from the striking face, said head has a gravitational center which is further from the trailing edge than the striking face and wherein said gravitational center is disposed substantially on said grip axis, and the shaft is secured to the portion of the head between the heel end and the sweet spot that projects forward of the striking face.

2. The golf club of claim 1 wherein the golf club is a putter.

3. The golf club of claim 1 wherein the portion of the head that projects forward of the striking face also projects forward of the vertical plane.

4. The golf club of claim 1 wherein said gravitational center is spaced less than about 0.65 inch from the vertical plane.

5. The golf club of claim 1 wherein a gravitational center of the golf club is disposed less than about 0.65 inch from the striking face.

6. The golf club of claim 1 wherein said gravitational center coincides with a sweet spot of the striking face.

7. The golf club of claim 1 wherein the head is formed of a single material.

8. The golf club of claim 1 wherein a portion of the portion of the head that projects forward of the striking face is less than 1.68 inches above a sole of the head.

9. The golf club of claim 1 wherein the grip axis is at, or forward of, the striking face.

10. The golf club of claim 1 wherein the grip axis is substantially aligned with the striking face.

11. A golf club comprising:

a shaft having a grip region at an upper end, said grip region defining a grip axis; and a head secured to a lower end of said shaft, said head having a forward face, a trailing edge, a club head mass, a heel end nearest the shaft connection, a toe end furthest from the shaft connection, and a sweet spot;

wherein a portion of the head between the heel end and the sweet spot projects forward of the striking face and no portion of the head between, the sweet spot and the toe end extends forward of the striking face, such that said club has a club gravitational center which is at, or forward of, a leading edge of the forward face and substantially on said grip axis.

12. The golf club of claim 11 wherein said gravitational center is substantially disposed at a point defined by the grip axis and the sweet spot on said forward face.

13. A golf club comprising:

a shaft;

a grip at an upper end of the shaft, the grip defining a grip axis inclined with respect to the vertical, said inclined grip axis defining a vertical plane, the grip defining a radius about the grip axis; and a plurality of parts assembled to form a head secured to a lower end of said shaft, said head having a striking face, a trailing edge, a head volume, a heel end nearest the shaft connection, a toe end furthest from the shaft connection, and a sweet spot;

wherein a portion of the head between the heel end and the sweet spot projects forward of the striking face and no portion of the head between the sweet spot and the toe end extends forward of the striking face, said head has a gravitational center which is at, or forward of, a leading edge of the striking face, the gravitational center is spaced from the vertical plane a distance less than the grip radius, and at least two of the plurality of parts assembled to form the head are formed of different materials having densities differing by at least 4.5 grams per cubic centimeter.

14. The golf club of claim 13 wherein said gravitational center is disposed substantially on said grip axis.

* * * * *